US005201188A

United States Patent [19]

Sakuma

[11] Patent Number: 5,201,188

[45] Date of Patent: Apr. 13, 1993

[54] REFRIGERANT RECYCLING SYSTEM WITH REFRIGERATION RECOVERING SCHEME

[75] Inventor: Tsutomu Sakuma, Yokohama, Japan

[73] Assignee: Kabushiki Kaisha Toshiba, Kawasaki, Japan

[21] Appl. No.: 739,512

[22] Filed: Aug. 2, 1991

[30] Foreign Application Priority Data

Aug. 22, 1990 [JP] Japan ..... 2-222251

[51] Int. Cl.[5] ..... F25B 45/00

[52] U.S. Cl. ..... 62/149; 62/77; 62/292

[58] Field of Search ..... 62/77, 149, 292

[56] References Cited

U.S. PATENT DOCUMENTS

| | | | |
|---|---|---|---|
| 3,664,147 | 5/1972 | Blackmon | 62/85 |
| 4,285,206 | 8/1981 | Koser | 62/149 X |
| 4,363,222 | 12/1982 | Cain | 62/292 |
| 4,441,330 | 4/1984 | Lower et al. | 62/149 |
| 4,476,688 | 10/1984 | Goddard | 62/149 |
| 4,539,817 | 9/1985 | Staggs | 62/149 |
| 4,624,112 | 11/1986 | Proctor | 62/292 X |
| 4,768,347 | 9/1988 | Manz et al. | 62/292 X |
| 4,805,416 | 2/1989 | Manz et al. | 62/292 |
| 4,856,289 | 8/1989 | Lofland | 62/292 X |
| 4,856,290 | 8/1989 | Rodda | 62/292 X |
| 5,077,984 | 1/1992 | Vance | 62/292 |
| 5,078,756 | 1/1992 | Major et al. | 62/292 X |
| 5,090,211 | 2/1992 | Peters | 62/292 X |

FOREIGN PATENT DOCUMENTS

| | | |
|---|---|---|
| 58-186016 | 10/1983 | Japan . |
| 63-311061 | 12/1988 | Japan . |
| 632841 | 10/1982 | Switzerland . |

*Primary Examiner*—John Rivell

*Attorney, Agent, or Firm*—Cushman, Darby & Cushman

[57] ABSTRACT

A refrigerant recovering sealed container has at least a refrigerant passing portion. A connecting portion connects the refrigerant passing portion of the refrigerant recovering sealed container to a refrigerant supply/discharge port of an existing refrigeration cycle unit. A cooling section cools the interior of the refrigerant recovering sealed container so that a refrigerant filled in the existing refrigeration cycle unit is introduced into the refrigerant recovering sealed container through the connecting portion as a gaseous refrigerant and is recovered as a liquefied refrigerant. A measuring section measures an amount of the refrigerant recovered in the refrigerant recovering sealed container as the liquefied refrigerant by the cooling section. A control unit supplies control signals for activating the connecting portion, the cooling section, and the measuring section in a predetermined order.

14 Claims, 6 Drawing Sheets

REFRIGERANT RECYCLING SYSTEM WITH REFRIGERATION RECOVERING SCHEME

BACKGROUND OF THE INVENTION

1. Field of the Invention

The present invention generally relates to a refrigerant recycling system and, more particularly, to a refrigerant recycling system used for recovery and recharging of a refrigerant of an already existing refrigeration cycle unit such as an air conditioner.

2. Description of the Related Art

Conventionally, when an air conditioner (refrigeration cycle unit) is to be repaired, installed, or relocated, the refrigerant in the refrigeration cycle circuit is discharged (discarded) first, required repair, installation, or relocation is performed, and thereafter a rated amount of a refrigerant is independently recharged in the refrigeration cycle circuit from a refrigerant supply/discharge port. When the capacity of the air conditioner is lowered due to natural refrigerant leakage, the refrigerant loss amount is not clear. Therefore, the refrigerant in the refrigeration cycle circuit is discharged to the air in a similar manner, and a rated amount of a refrigerant is recharged in the refrigeration cycle circuit from the refrigerant supply/discharge port.

In such an existing refrigeration cycle unit, fluorocarbons, the use of which is regulated currently, are widely used as the refrigerant. However, it is pointed out that, since fluorocarbons have a very high chemical stability, when they are discharged in the air, they reach the stratosphere to destroy the ozone layer. For this reason, fluorocarbons are believed to be a factor that causes the increase in ultraviolet rays radiated from the universe onto the earth and the greenhouse effect in which the earth surface temperature is increased.

Even if the other refrigerants, such as R-22 etc., which are had small of ozone destroying coefficients, are used, it is a waste of resources if they are directly discharged in the air, and is thus not preferable.

Hence, a development of a refrigerant recycling system, which enables a required work for a refrigeration cycle unit such as repair and relocation without discharging a refrigerant, such as fluorocarbon or its substitute, in the air, is urgently sought for in various fields.

In development of such a refrigerant recycling system, the following points must be considered:

(a) the refrigerant should not be damaged during recovery;

(b) the refrigerant recovery/recharge amount can be measured easily and correctly;

(c) the processing time is short; and (d) a lubricant in the compressor of the refrigeration cycle circuit should not be recovered together with the refrigerant.

SUMMARY OF THE INVENTION

It is, therefore, an object of the present invention to provide a new and improved refrigerant recycling system with a refrigerant recovering scheme, which can efficiently recover only the refrigerant without recovering a lubricant in the compressor of the refrigeration cycle circuit together with the refrigerant.

It is another object of the present invention to provide a refrigerant recycling system for recovering a refrigerant from a refrigeration cycle circuit, adjusting the recovered refrigerant to a rated amount, and returning the adjusted refrigerant to the refrigeration cycle unit.

It is still another object of the present invention to provide a refrigerant recycling method for recovering a refrigerant from a refrigeration cycle circuit, adjusting the recovered refrigerant to a rated amount, and returning the adjusted refrigerant to the refrigeration cycle unit.

According to a first aspect of the present invention, there is provided a refrigerant recycling system comprising:

a refrigerant recovering sealed container having at least refrigerant passing means;

connecting means for connecting the refrigerant passing means of the refrigerant recovering sealed container to a refrigerant supply/discharge port of an existing refrigeration cycle unit;

cooling means for cooling the interior of the refrigerant recovering sealed container so that a refrigerant filled in the existing refrigeration cycle unit is introduced into the refrigerant recovering sealed container through the connecting means as a gaseous refrigerant and is recovered as a liquefied refrigerant;

measuring means for measuring an amount of the refrigerant recovered in the refrigerant recovering sealed container as the liquefied refrigerant by the cooling means; and control means for supplying control signals for activating the connecting means, the cooling means, and the measuring means in a predetermined order.

According to a second aspect of the present invention, there is provided a refrigerant recycling system comprising:

a connecting portion detachable from a refrigerant supply/discharge port of an existing refrigeration cycle unit;

a tank connected to the connecting portion;

means for evacuating a system including the tank to a vacuum state by vacuum suction;

means for recovering a refrigerant filled in the refrigeration cycle unit into the tank by causing the system including the tank to communicate with the connecting portion and cooling the tank after the vacuum state is set, and synchronously liquefying the refrigerant recovered in the tank;

means for measuring an amount of the liquefied refrigerant in the tank;

means for replenishing a refrigerant to the tank when the measurement result shows that the amount of the refrigerant in the tank is insufficient, thereby adjusting the refrigerant to a rated amount;

means for heating the tank after the refrigerant is adjusted to the rated amount; and means for causing the tank to communicate with the connecting portion to recharge the refrigerant of the rated amount which is pressurized by heating to the existing refrigeration cycle unit.

According to a third aspect of the present invention, there is provided a refrigerant recycling method comprising the steps of:

connecting a refrigerant supply/discharge port of an existing refrigeration cycle unit to a refrigerant recovering tank;

evacuating a system including the tank to a vacuum state by vacuum suction;

causing the system including the tank to communicate with the connecting portion and the cooling the tanks, after the vaccum state is formed, thereby recovering the refrigerant filled in the refrigeration cycle unit into the tank, and synchronously liquefying the refrigerant recovered in the tank;

measuring an amount of the liquefied refrigerant in the tank;

adjusting the refrigerant to a rated amount by replenishing a refrigerant to the tank, when the measurement result shows that the amount of the refrigerant in the tank is insufficient;

heating the tank, after the refrigerant is adjusted to the rated amount; and causing the tank to communicate with the connecting portion, thereby recharging the refrigerant of the rated amount which is pressurized by heating to the existing refrigeration cycle unit.

According to the refrigerant recycling system of the present invention, when, e.g., a lowered capacity of an existing refrigeration cycle unit due to a natural refrigerant leakage is to be corrected, e.g., a connecting section is connected to the refrigerant supply/discharge port of the refrigeration cycle unit. Then, vacuum suction is performed to evacuate the system including the tank. As a result, water and the like that can damage the refrigerant is removed from the system.

The system including the tank is evacuated in this manner. Subsequently, the system including the tank is caused to communicate with the connecting section. Then, the refrigerant in the refrigeration cycle unit is recovered in the tank because of the differential pressure between the pressure in the tank and the saturated vapor pressure in the existing refrigeration cycle unit. Thereafter, the pressure in the tank is increased in accordance with the saturated vapor pressure. In this case, since the tank is cooled, and the pressure in the tank is reduced in accordance with the cooling thereby to continue the recovering operation, the recovered refrigerant is liquefied in the tank. Thus, the refrigerant in the existing refrigeration cycle unit is liquefied and reserved in the tank.

Subsequently, the amount of the liquefied refrigerant recovered in the tank is measured. Since the measurement result shows that the refrigerant amount is not sufficient, an amount of a refrigerant corresponding to the deficient amount is replenished in the tank. As a result, the refrigerant is adjusted to the rated amount for the existing refrigeration cycle unit by directly using the refrigerant charged in the existing refrigeration cycle unit.

After the adjustment, the tank is heated to increase its internal pressure. The tank is caused to communicate with the connecting section so that the refrigerant in the tank is charged in the existing refrigeration cycle unit from the refrigerant supply/discharge port as the tank pressure is increased.

As a result, the refrigerant of the existing refrigeration cycle unit, which has been currently discharged in the air, is recovered, adjusted to a precise, optimum amount, and is returned to the existing refrigeration cycle unit.

Hence, according to the present invention, a required work for the refrigeration cycle unit such as repair and relocation can be performed while preventing the refrigerant from being discharged in the air.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
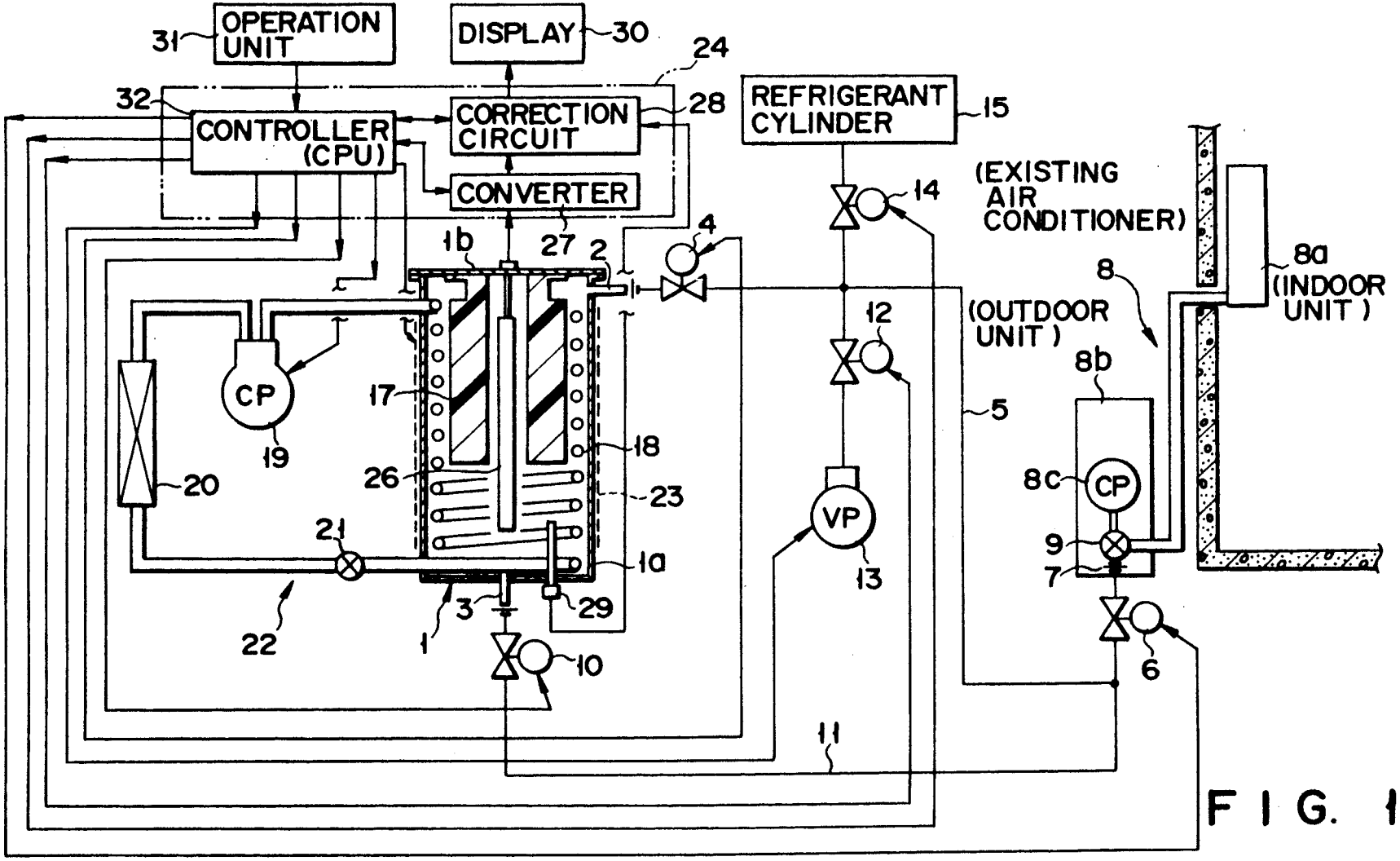
FIG. 1 shows the arrangement of a refrigerant recycling system according to the first embodiment of the present invention.

Reference will now be made in detail to the presently preferred embodiments of the invention as illustrated in the accompanying drawings, in which like reference characters designate like or corresponding parts throughout the several drawings.

Figure 2A:
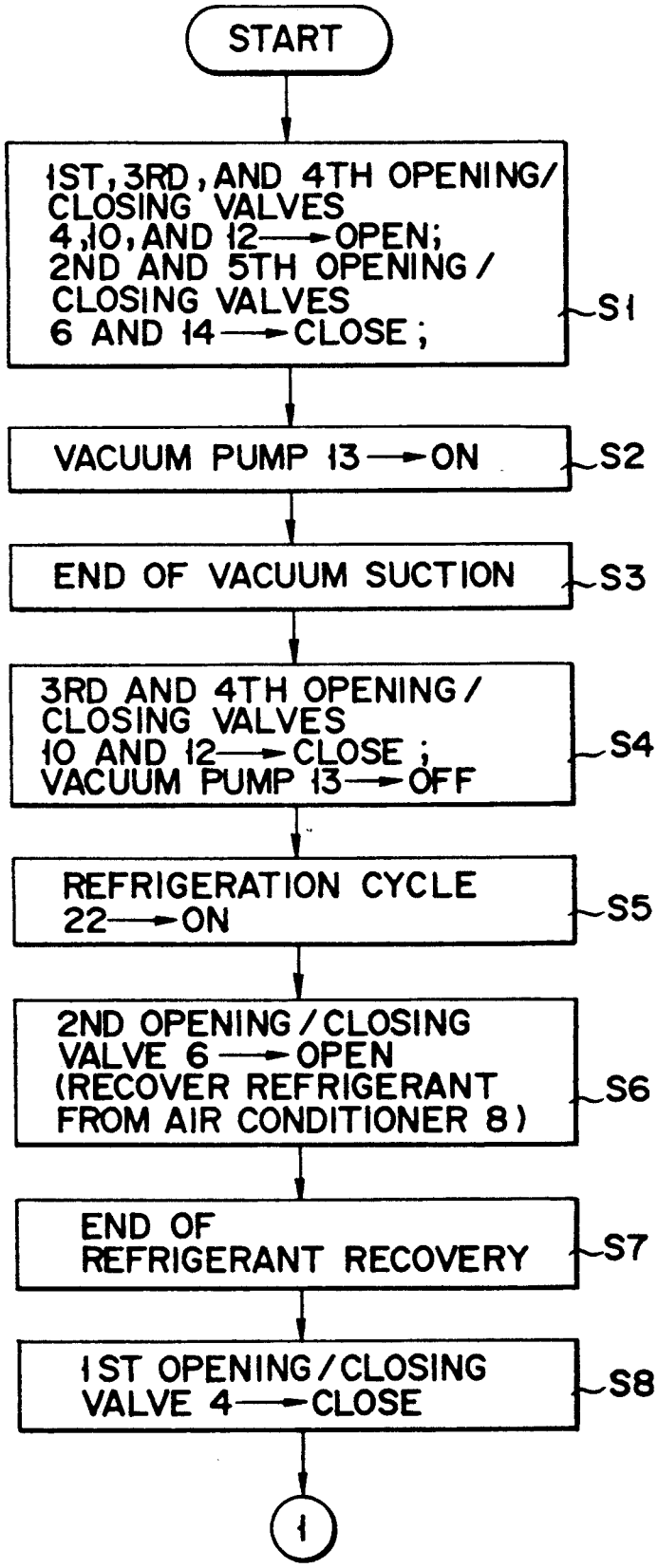
FIGS. 2A and 2B are flow charts sequentially showing the steps of recovering the refrigerant of an air conditioner by the refrigerant recycling system shown in FIG. 1, adjusting it to a rated amount, and returning it to the air conditioner.
Figure 2B:
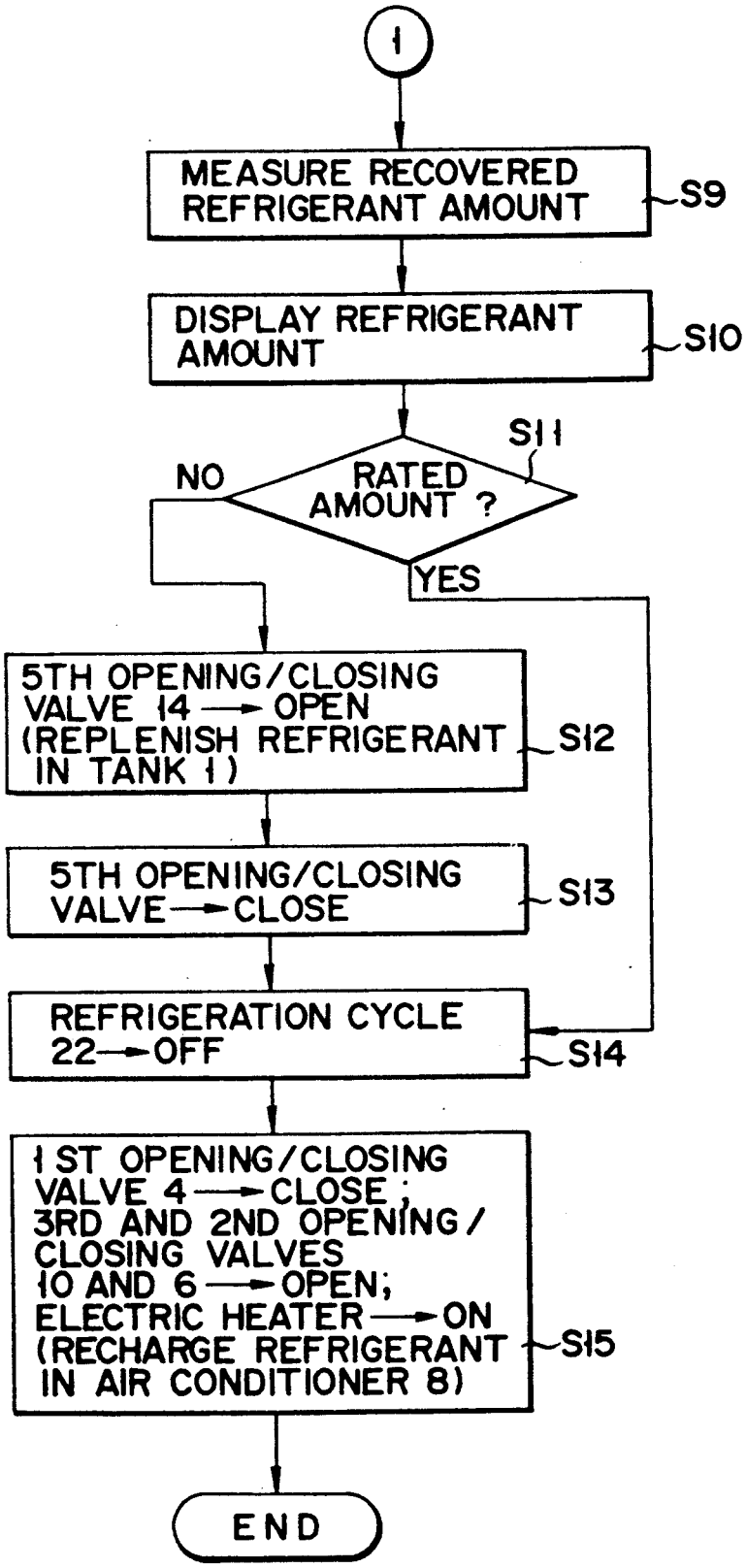
Figure 3:
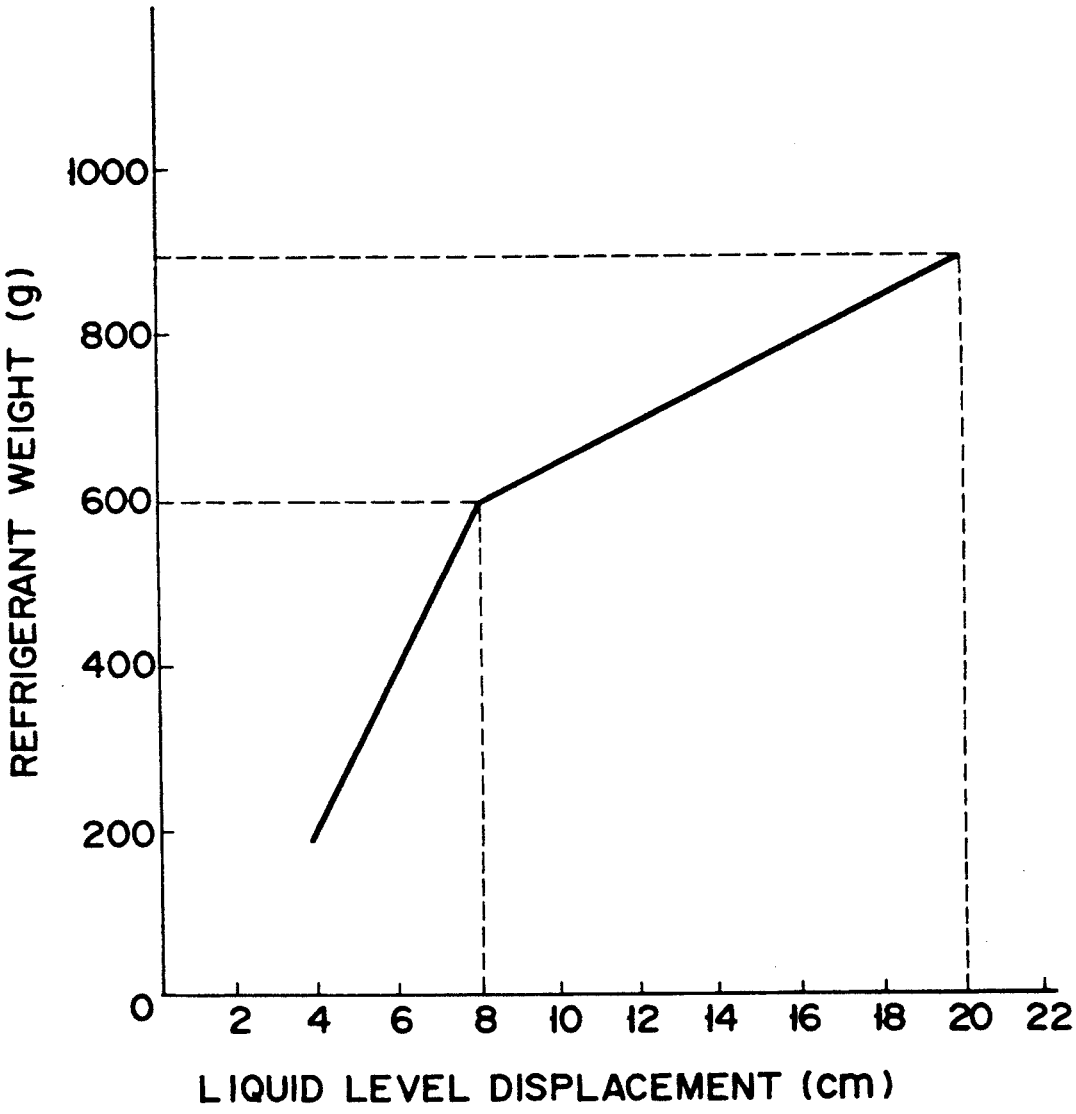
FIG. 3 shows the relationship between the liquid level of the liquid refrigerant in the tank of FIG. 1 and the liquid refrigerant weight.
Figure 4:
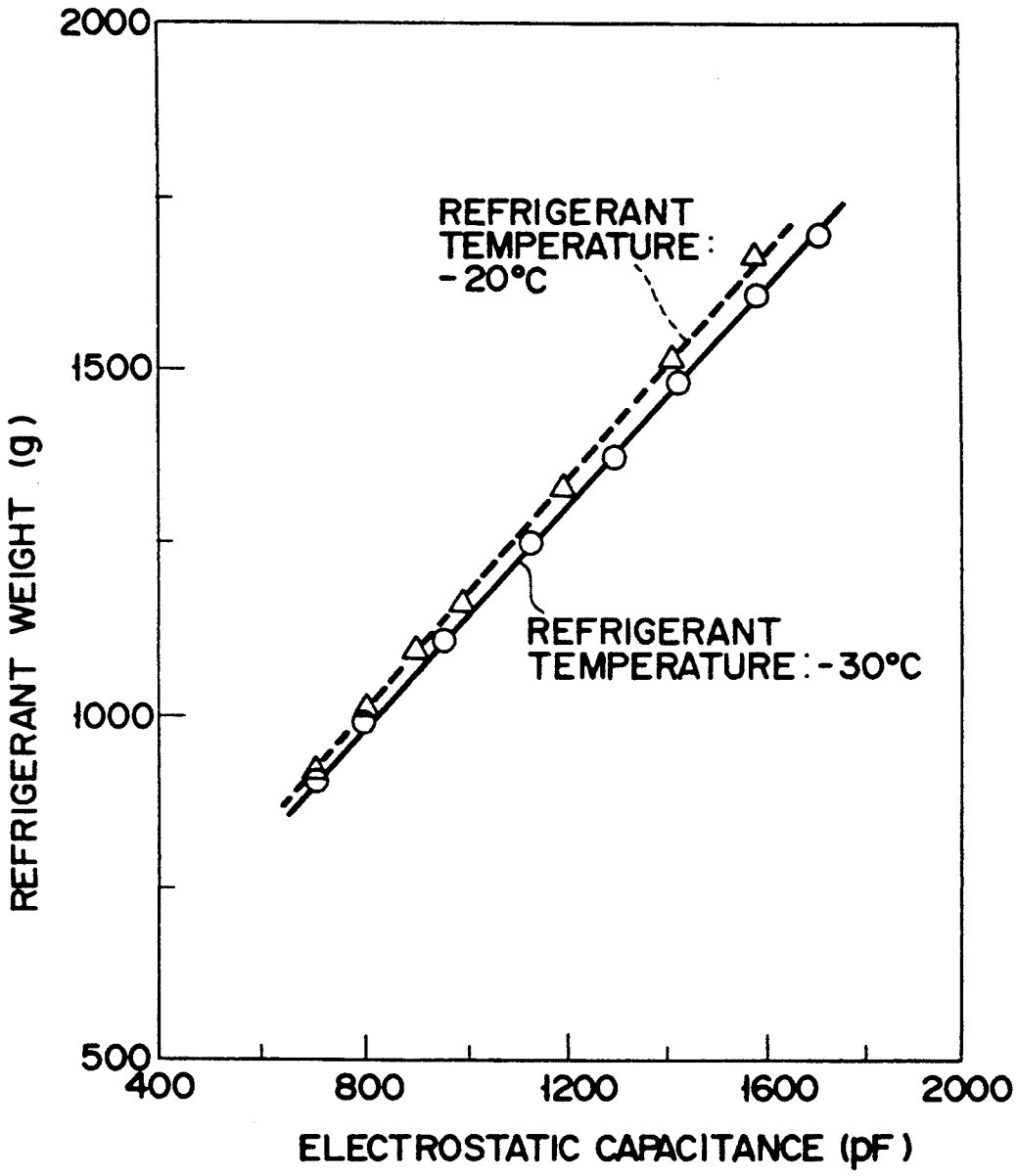
FIG. 4 shows the temperature characteristics of the electrostatic capacitance measured by the liquid level sensor of FIG. 1 and the refrigerant weight.

The present invention will be described with reference to the first embodiment shown in FIGS. 1 to 3. FIG. 1 shows a refrigerant recycling system. Reference numeral 1 denotes a tank as the refrigerant recovery sealed container. The tank 1 is obtained by flange-coupling the upper open end of, e.g., a cylindrical container 1*a* with a lid 1*b*. A refrigerant flow inlet 2 is formed in the upper portion of the wall of the tank 1, and a refrigerant flow outlet 3 is formed in the bottom of the tank 1.

The refrigerant flow inlet 2 is connected to a refrigerant recovering pipe 5 through a first opening/closing valve 4 comprising a two-way solenoid valve. The distal end of the pipe 5 is connected to a connecting joint 7 (corresponding to a connecting section) through a second opening/closing valve 6 comprising a two-way solenoid valve. The connecting joint 7 can be connected to a refrigerant supply/discharge port 9, called a service port, provided to an outdoor unit 8*b* of an existing refrigeration cycle unit, e.g., a home air conditioner 8 having a combination of an indoor unit 8*a* and the outdoor unit 8*b*. The refrigerant can be guided into the tank 1 from the refrigeration cycle circuit of the air conditioner 8 through the connecting joint 7.

The refrigerant flow outlet 3 is connected to a third opening/closing valve 10 comprising a two-way solenoid valve. The third opening/closing valve 10 is parallel-connected to the pipe portion of the second opening/closing valve 6, which is on the opposite side of the connecting joint 7, through a refrigerant charging pipe 11. The refrigerant in the tank 1 can be guided to the refrigerant supply/discharge port 9 through the connecting joint 7.

A vacuum pump (VP) 13 is connected midway along the pipe 5 through a fourth opening/closing valve 12 comprising a two-way solenoid valve. As a result, while the first, third, and fourth opening/closing valves 4, 0, and 12 are open and the second opening/closing valve is closed, when the VP 13 is activated to perform vacuum suction, a flow path system (refrigerant recovery and recharging) including the tank 1 can be evacuated. After the vacuum state is generated, when the VP pump 13 is stopped, the third and fourth opening/closing valves 0 and 12 are closed, the second opening/closing valve 6 is opened, and simultaneously a refrigeration cycle 22 (to be described later) is turned on, the refrigerant in the existing air conditioner 8 can be recovered in the tank 1 in accordance with the refrigeration recovering scheme (differential pressure).

A refrigerant cylinder 15 (a cylinder in which the refrigerant is filled) is connected midway along the pipe 5 through a fifth opening/closing valve 14 comprising a two-way solenoid valve. Thus, the refrigerant can be replenished into the tank 1 through the pipe 5.

A thick cylindrical core 17 is provided at the central portion of the interior of the tank 1 to project inwardly from the central portion of the lid 1*b*. An electrostatic capacitance type liquid level sensor 26 supported by the lid 1*b* is vertically arranged in the space at the central portion in the core 17. More specifically, the liquid level sensor 26 has different dielectric constants at its portions contacting and not contacting the liquefied refrigerant. Hence, the sensor 26 shows an electrostatic capacitance corresponding to a liquid level. A coil evaporator 18 is arranged in a space inside the tank 1 defined by the outer circumferential surface of the core 17 and the inner circumferential surface of the cylinder 1*a*. The evaporator 18 is sequentially connected to a compressor (CP) 19, a condenser 20, and an expansion valve 21 (pressure reducing unit) installed outside the tank 1, thereby constituting the refrigeration cycle 22 cooling the tank 1. When the refrigeration cycle 22 is operated, the pressure inside the tank 1 is decreased, and at the same time the refrigerant flowing into the tank 1 can be liquefied.

Reference numeral 24 denotes a control unit. The control unit 24 incorporates a converter 27 and a correction circuit 28. The converter 27 converts an electrostatic capacitance indicating a liquid level of the liquefied refrigerant in the tank 1, which is output from the liquid level sensor 26, to a voltage indicating a refrigerant weight using a predetermined conversion coefficient. The correction circuit 28 is connected to the converter 27, and corrects a voltage indicating a refrigerant weight in accordance with the refrigerant temperature as the specific weight of the refrigerant differs depending on the temperature. The correction circuit 28 is also connected to a temperature sensor 29 for detecting the refrigerant temperature provided on the bottom of the tank 1. Thus, a voltage indicating the temperature of the liquefied refrigerant can be input to the correction circuit 28. The correction circuit 28 is also connected to a display 30 for displaying, e.g., a refrigerant weight by, e.g., digital indication. Thus, a temperature-corrected refrigerant weight can be displayed by the display 30. In other words, the refrigerant amount recovered in the tank 1 can be measured.

An example of temperature correction of the refrigerant weight by the correction circuit 28 will be described.

Figure 5:
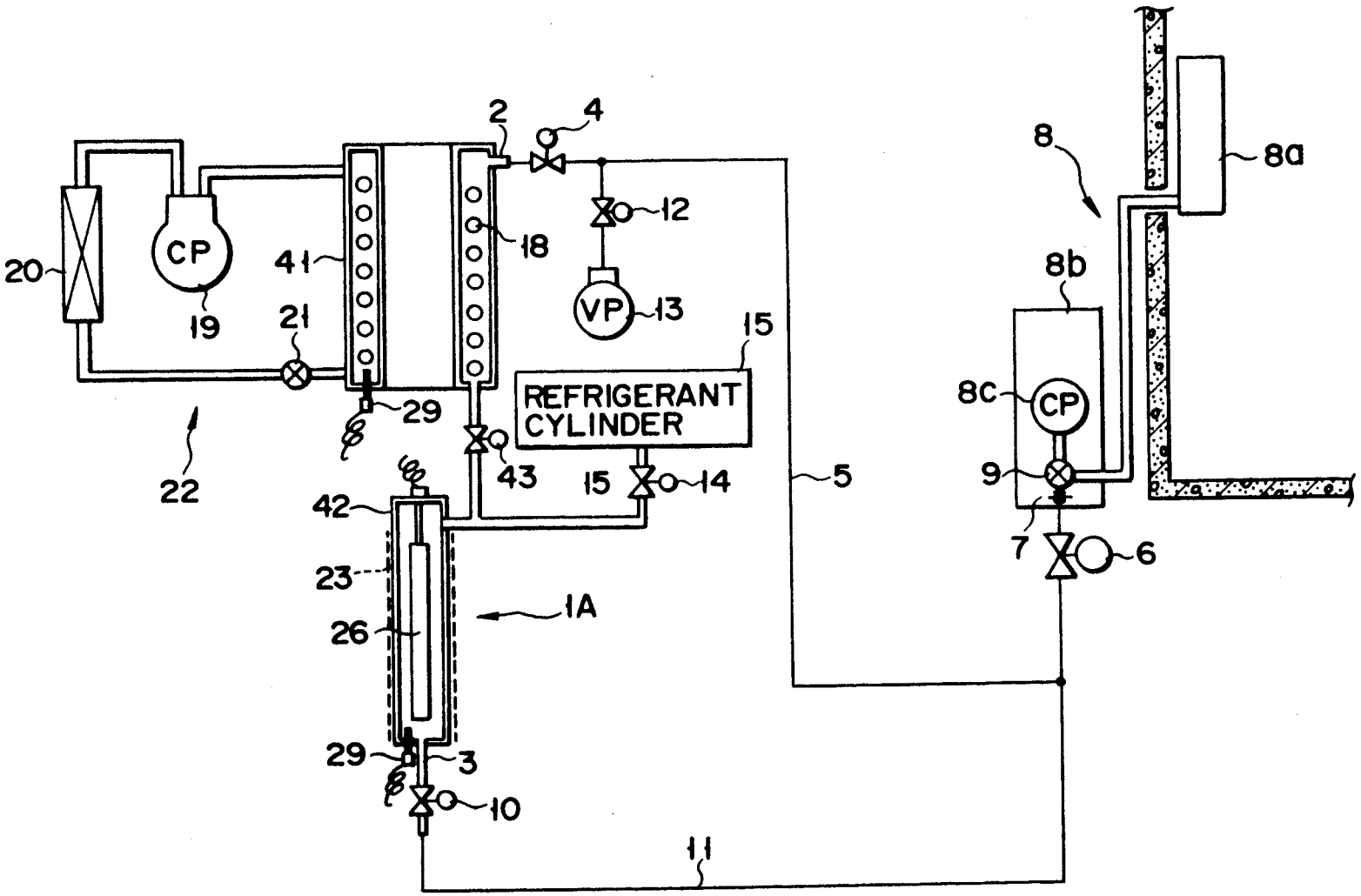
FIG. 5 shows the arrangement of a refrigerant recycling system according to the second embodiment of the present invention.

The density and the dielectric constant (electrostatic capacitance coefficient) of a refrigerant differ depending on the temperature. A comparison will be made between −20° C. and −30° C. When the temperature is −20° C., the density is 1,377 kg/m$^3$ and the dielectric constant is 8.5. When the temperature is −30° C., the density is 1,346 kg/m$^3$ and the dielectric constant is 9.2. FIG. 5 shows the relationship between the electrostatic capacitance and the refrigerant weight when the refrigerant temperature is −20° C. and −30° C. The refrigerant weight exhibiting the same electrostatic capacitance is increased by 2% at −20° C. compared to −30° C.

Accordingly, with reference to −30° C., the correction circuit 28 can correct at a sufficient precision the voltage indicating the electrostatic capacitance by adding or subtracting 0.2% its value to or from it for a temperature change of 1° C.

The refrigerant temperature is preferably −25° to −30° C. considering a recovery ratio.

When the measured value of the recovered refrigerant amount is automatically or manually compared with the optimum refrigerant amount (rated amount) described on the name plate or in the manual (not shown) of, e.g., an existing air conditioner 8, whether or not the amount of the recovered refrigerant is sufficient is discriminated. Furthermore, when the refrigerant is replenished from the refrigerant cylinder 15 into the tank 1 while monitoring the display as needed to achieve the optimum refrigerant amount, the refrigerant amount of the existing air conditioner 8 can be adjusted to an optimum amount suited to it.

An electric heater 23 is arranged around the tank 1 to heat it. After the refrigerant amount is adjusted, when the electric heater 23 is energized, the first opening/closing valve 4 is closed and the third opening/closing valve 10 is opened an optimum amount of the refrigerant pressurized by heating can be recharged into the refrigeration cycle circuit of the air conditioner 8 from the refrigerant supply/discharge port 9 through the open second opening/closing valve 6.

The control unit 24 incorporates a controller (CPU) 32. The controller 32 turns on/off or opens/closes the various units of the refrigerant recycling system and performs various comparative arithmetic operations in accordance with the various operation data input from an operation unit 31.

The operation of the refrigerant recycling system having the above arrangement will be described with reference to the flow charts of FIGS. 2A and 2B.

First, assume that a lowered air conditioning capacity of the existing air conditioner 8 caused by natural refrigerant leakage is to be corrected. In this case, the operator connects the refrigerant supply/discharge port 9 of the outdoor unit 8*b* of the existing air conditioner 8 to the connecting joint 7.

Then, when the operator starts the operation by the operation unit 31, the CPU 32 generates an instruction to open the first, third, and fourth opening/closing valves 4, 10, and 12 and to close the second and fifth opening/closing valves 6 and 14 (step S1).

Thereafter, the CPU 31 generates an instruction to operate the VP 13 (step S2). Air is exhausted from the closed loop constituted by the pipe 5, the tank 1, and the pipe 11 by the operation of the VP 13. By this vacuum suction, water and the like that can damage the refrigerant are removed from the flow path system (refrigerant recovery and recharging) including the tank 1. Vacuum suction need not be constantly performed but may be performed only when water is present in the flow path system including the tank 1.

The CPU 32 continues vacuum suction for a period of time required for evacuating, e.g.. the closed loop. As a result, the flow path system (refrigerant recovery/recharging system) including the tank 1 is evacuated (S3). When a predetermined period of time elapses, the third and fourth opening/closing valves 10 and 12 are closed and the operation of the VP 13 is stopped (step S4).

Subsequently, the CPU 32 starts the compressor (CP) 19 to operate the refrigeration cycle 22 (step S5). Then, a cooling cycle of the refrigerant discharged from the compressor 19 and passing through the condenser 20, the expansion valve 21, and the evaporator 18 sequentially is formed, and the tank 1 is cooled. After that, the CPU 32 opens the second opening/closing valve 6 (step S6).

Then, the refrigerant filled in the refrigeration cycle circuit of the existing air conditioner 8 flows into the tank 1 at a low pressure from the refrigerant flow inlet 2 through the refrigerant supply/discharge port 9, the connecting joint 7, the pipe 5, and the first opening/-closing valve 4 by the differential pressure between the interior of the tank 1 and the saturated vapor pressure.

At this time, the initial temperature and pressure inside the tank 1 temporarily become the temperature of the recovered refrigerant and the saturated vapor pressure. However, since the tank 1 is cooled, the temperature and pressure inside the tank 1 are gradually decreased. Then, the recovered refrigerant is condensed and liquefied to accumulate in the tank 1. The refrigerant in the existing air conditioner 8 is recovered in the tank 1 by this cooling.

More specifically, assume that "R-22" is used as the refrigerant. When the refrigerant temperature is decreased down to "−30° C.", the pressure inside the tank 1 becomes the saturated vapor pressure, "about 0.7 kg/cm$^2$G", corresponding to this temperature. Thus, the refrigerant filled in the refrigeration cycle circuit of the existing air conditioner 8 is recovered until the pressure in the refrigeration cycle circuit becomes the saturated vapor pressure (step S7). When this state is attained, the CPU 32 closes the second opening/closing valve 6 (step S8).

The refrigerant recovering steps described above are performed with the refrigeration scheme of the refrigeration cycle added to the tank 1 while the air conditioner 8 is kept stopped. Therefore, only the refrigerant can be recovered and the lubricant in the compressor of the outdoor unit **8*b*** is not recovered together with the refrigerant.

In this manner, the level of the liquefied refrigerant accumulated in the tank 1 is detected by the level sensor 26. A predetermined proportional relationship exists between the liquid level and the refrigerant weight. Thus, the refrigerant amount recovered in the tank 1 is measured by converting the level to the refrigerant weight by the converter 27 (step S9). The measured value, i.e., the recovered refrigerant amount is displayed as the weight on the display 30 (step S10).

Then, it is discriminated in step S11 whether or not the recovered refrigerant amount is of the rated amount. NO is obtained in step S11 as this explanation is based on an assumption that natural refrigerant leakage occurred in the air conditioner 8, and a value less than the optimum refrigerant amount for the existing air conditioner 8 is displayed More specifically, the optimum refrigerant amount for a 1 horsepower air conditioner 8 is about 900 g. If the recovered refrigerant amount is 500 g, the refrigerant is deficient by 400 g.

More precisely, the optimum refrigerant amount is the value obtained by subtracting from this 900 g the amount of the non-liquefied gaseous refrigerant contained in the tank 1 and the amount of the non-recovered gaseous refrigerant in the air conditioner 8. In accordance with this consideration, the optimum refrigerant amount can be obtained in the following manner.

More specifically, the amount of the non-liquefied gaseous refrigerant contained in the tank 1 is the amount obtained by subtracting the liquefied refrigerant amount from the internal volume of the tank 1. Assume that the non-liquefied gaseous refrigerant amount is 0.0014 m$^3$. Since its specific volume is 0.133 m$^3$ when the internal pressure of the tank 1 is 0.7 kg/cm$^2$G, the converted value of the non-liquefied gaseous refrigerant weight is about 10 g. On the side of the air conditioner 8, the ratio of the gaseous refrigerant to the entire volume of its refrigeration cycle circuit corresponds to the volume of the non-recovered gaseous refrigerant. Assume that the non-recovered gaseous refrigerant volume is about 0.0034 m$^3$ (when the capacity of the compressor used for the outdoor unit **8*b*** is of the 1 horse-power class), and that the specific volume is 0.168 m$^3$/Kg (e.g., when the temperature of the gaseous refrigerant is 25° C. in summer time). Then, the converted value of the non-recovered gaseous refrigerant weight is about 20 g. In fine, the optimum refrigerant amount is 870 g obtained by subtracting 10 g +20 g=30 g from 900 g.

Thereafter, the CPU 32 opens the first opening/closing valve 14 in response to the operatic by the operation unit 31 to replenish the refrigerant in the tank 1 from the refrigerant cylinder 15 (step S12). Then, as the refrigerant is replenished, the liquid level of the tank 1 is elevated.

The core 17 is provided at such a position inside the tank 1 as to increase a liquid level change corresponding to a unit refrigerant amount within a region of 600 g or more. As shown in FIG. 3, using 600 g at which the liquid level reaches the lower surface of the core 17 as a boundary, before the liquid level reaches the lower surface of the core 17, the refrigerant amount per unit liquid level change is 100 g/cm, and after that, it is 25 g/cm. More specifically, the refrigerant amount exceeds 600 g, the display 30 can display the refrigerant amount with a high precision in consideration of the presence of the core 17.

The operator operates the operation unit 31 as he monitors the displayed refrigerant amount until the optimum refrigerant amount (870 g) is obtained, thereby replenishing the refrigerant from the refrigerant cylinder 15. As a result, the necessary amount of the refrigerant is replenished in the tank with a high precision.

This means that the refrigerant of the existing air conditioner 8 is directly recovered and is adjusted to the rated amount for the existing air conditioner 8.

Furthermore, in fact, the optimum amount of the refrigerant to be replenished is added the remaining amount of the refrigerant in the tank 1, when the refrigerant is replenished to the existing air conditioner 8.

When the adjustment of the recovered refrigerant amount is ended, the CPU 32 closes the fifth opening/-closing valve 14 in accordance with the operation at the operation unit 31 and stops operation of the refrigeration cycle 22 (steps S13 and S14).

Then, the CPU 32 closes the first opening/closing valve 4, and opens the second and third opening/closing valve 6 and 10 and energizes the electric heater 23. The tank 1 is heated and its interior is pressurized. As the tank internal pressure is increased, the refrigerant in the tank 1 flows in the open third and second opening/-closing valves 10 and 6 and the connecting joint 7 and is recharged and replenished in the refrigeration cycle circuit of the existing air conditioner 8 through the refrigerant supply/discharge port 9. Hence, the air conditioning capacity of the existing air conditioner 8 is recovered.

In this manner, the refrigerant of the existing air conditioner 8, which has conventionally been discharged in the air for repair or relocation of the air conditioner 8, is recovered and adjusted to the correct optimum refrigerant amount, and is returned to the existing air conditioner 8.

As a result, a required work, e.g., repair and relocation, for a refrigeration cycle unit, such as the existing air conditioner 8, can be performed while preventing the refrigerant from being discharged in the air.

If the existing air conditioner 8 is operated when the refrigerant is to be recharged to it, the refrigerant is drawn by suction by its compressor 8c. Then, the time required for recharging is reduced by this.

In the above description, the refrigerant is recharged in the air conditioner 8 semi-automatically as the operator monitors the value of the display 30. However, the present invention is not limited to this, and the refrigerant can be recharged full-automatically by the control unit 24.

FIG. 5 shows the second embodiment of the present invention.

In the second embodiment, a tank 1A is split into two sub-tanks of a refrigerant recovery tank 41 and a refrigerant measuring tank 42 series-connected to the tank 41 through a sixth opening/closing valve 43 (comprising a two-way solenoid valve). The refrigerant recovery tank 41 performs the steps till recovery. Then, the refrigerant measuring tank 42 performs the steps till measurement and adjustment of the recovered refrigerant amount and refrigerant recharging.

More specifically, according to the second embodiment, the refrigerant is recovered into the refrigerant recovery tank 41 from the existing air conditioner 8 (refrigerant cycle unit) by the refrigeration scheme (differential pressure), and the recovered refrigerant is cooled by the refrigeration cycle 22, liquefied, and accumulated in the tank 41. When the refrigerant is to be returned to the existing air conditioner 8, the liquefied refrigerant is transferred to the refrigerant measuring tank 42 from the refrigerant recovery tank 41, and its amount in the refrigerant measuring tank 42 is measured in the tank 42. When the refrigerant amount is insufficient, it is adjusted to the rated amount by replenishing a supplementary refrigerant from the refrigerant cylinder 15. Then, the electric heater 23 heats the refrigerant measuring tank 42 so that the refrigerant in the tank 42 is returned to the existing air conditioner 8. Although the control system is not shown in the second embodiment, it is identical with that of the first embodiment and is thus omitted.

In the second embodiment, a hollow cylindrical tank is used as the refrigerant recovery tank 41 in order to increase the heat exchange efficiency. A coil evaporator 18 is arranged inside the tank 41. As a result, the contact area of the recovered refrigerant with the evaporator 18 is increased.

In the second embodiment, the same constituent elements as in the first embodiment are denoted by the same reference numerals and a detailed description thereof is omitted.

In the embodiments described above, the present invention is exemplified by the existing air conditioner from which the refrigerant is to be recovered. However, the present invention is not limited to this, and can apparently be suitably used for recycling of the refrigerant in another refrigeration cycle unit such as an existing refrigerator and a freezer.

In the embodiments described above, two separate pipes are used for recovery and recharging. However, a single pipe may be used to perform both the functions (recovery system, the recharging system).

As has been described above, according to the present invention, a refrigerant of an existing refrigeration cycle unit, which has conventionally been discharged in the air when the refrigeration cycle unit is to be repaired or relocated, can be recovered, adjusted to the rated amount, and returned to the existing refrigeration cycle unit.

As a result, necessary operations, e.g., repair and relocation, of the refrigeration cycle unit can be performed while preventing the refrigerant from being discharged in the air.

Additional embodiments of the present invention will be apparent to those skilled in the art from consideration of the specification and practice or the present invention disclosed herein. It is intended that the specification and examples be considered as exemplary only, with the true scope of the present invention being indicated by the following claims.

What is claimed is:

1. A refrigerant recycling system comprising:

a refrigerant recovering sealed container having at least refrigerant passing means;

connecting means for connecting said refrigerant passing means of said refrigerant recovering sealed container to a refrigerant supply/discharge port of an existing refrigeration cycle unit;

cooling means for cooling the interior of said refrigerant recovering sealed container so that a refrigerant filled in said existing refrigeration cycle unit is introduced into said refrigerant recovering sealed container through said connecting means as a gaseous refrigerant and is recovered as a liquefied refrigerant;

measuring means for measuring an amount of the refrigerant recovered in said refrigerant recovering sealed container as the liquefied refrigerant by said cooling means, the measuring means including a liquid level sensor provided inside said refrigerant recovering sealed container, the liquid level sensor including an electrostatic capacitive liquid level sensor that indicates an electrostatic capacitance corresponding to a liquid level of the liquefied refrigerant in said refrigerant recovering sealed container; and control means for supplying control signals for activating said connecting means, said cooling means, and said measuring means in a predetermined order.

2. A system according to claim 1, wherein said control means includes converting means for converting the electrostatic capacitance corresponding to the liquid level sent from said electrostatic capacitive liquid level sensor into a voltage indicating a weight of the refrigerant.

3. A system according to claim 2, wherein:

said measuring means includes a temperature sensor, provided in said refrigerant recovering sealed container, for measuring a temperature of the liquefied refrigerant; and said control means includes correction means for correcting the voltage supplied from said converting means and indicating the weight of the refrigerant in accordance with a temperature detection output sent from said temperature sensor.

4. A system according to claim 3, wherein said system further comprises display means for displaying the weight of the refrigerant recovered in said sealed container in accordance with the output corrected by said correcting means.

5. A system according to claim 3, wherein said control means includes means for controlling the temperature of the liquefied refrigerant to said sealed container cooled by said cooling means to −(25 to 30)° C.

6. A system according to claim 1, wherein said system further comprises refrigerant replenishing means for allowing said existing refrigeration cycle unit to externally replenish a refrigerant when the amount of the refrigerant measured by said measuring means is less than a rated amount.

7. A system according to claim 6, wherein said system further comprises heating means for heating the interior of said refrigerant recovering sealed container so that the liquefied refrigerant recovered in said sealed container through said connecting means is introduced to said existing refrigeration cycle unit as a gaseous refrigerant by a pressurizing scheme.

8. A system according to claim 7, wherein said connecting means includes first and second connecting systems separately provided as a refrigerant recovery system and a refrigerant recharging system.

9. A system according to claim 7, wherein said heating means includes electric heater means provided along an outer wall of said sealed container.

10. A system according to claim 1, wherein said cooling means includes a refrigeration cycle having a coil evaporator provided along an inner wall of said sealed container, a compressor series-connected to said evaporator and provided outside said sealed container, a condenser, and an expansion valve.

11. A system according to claim 1, wherein said sealed container includes core means for increasing a liquid level change corresponding to a unit amount of the liquefied refrigerant in said sealed container when the weight of the liquefied refrigerant is above a predetermined weight.

12. A system according to claim 1, wherein said system further comprises evacuating means for evacuating the interior of said sealed container and said connecting means to a vacuum state in advance.

13. A refrigerant recycling system comprising;

a connecting portion detachable from a refrigerant supply/discharge port of an existing refrigeration cycle unit;

a tank connected to said connecting portion;

means for evacuating a system including said tank to a vacuum state by vacuum suction;

means for recovering a refrigerant filled in said existing refrigeration cycle unit into said tank by causing said system including said tank to communicate with said connecting portion and cooling the tank after the vacuum state is set, and synchronously liquefying the refrigerant recovered in said tank means for measuring an amount of the liquefied refrigerant in said tank, said measuring means including an electrostatic capacitive liquid level sensor provided in said tank, and means for converting an electrostatic capacitance sent from said liquid level sensor and corresponding to a liquid level change into a voltage indicating a weight of the refrigerant;

means for replenishing a refrigerant to said tank when the measurement result shows that the amount of adjusting the refrigerant to a rated amount;

means for heating said tank after the refrigerant is adjusted to the rated amount; and means for causing said tank to communicate with said connecting portion to recharge the refrigerant of the rated amount which is pressurized by heating to said existing refrigeration cycle unit.

14. A system according to claim 13, wherein said measuring means further includes means for correcting the voltage indicating the weight of the refrigerant sent from said converting means in accordance with a temperature of the refrigerant in said tank.

* * * * *